US008733025B2

(12) United States Patent
Baumert

(10) Patent No.: US 8,733,025 B2
(45) Date of Patent: May 27, 2014

(54) PREHUNG DOOR UNIT STRUCTURE

(75) Inventor: Bernard Baumert, Schaeffersheim (FR)

(73) Assignee: Baumert, Schaeffersheim (FR)

( * ) Notice: Subject to any disclaimer, the term of this patent is extended or adjusted under 35 U.S.C. 154(b) by 0 days.

(21) Appl. No.: 13/703,163

(22) PCT Filed: Jun. 10, 2010

(86) PCT No.: PCT/FR2010/051155

§ 371 (c)(1),
(2), (4) Date: Dec. 10, 2012

(87) PCT Pub. No.: WO2011/154618

PCT Pub. Date: Dec. 15, 2011

(65) Prior Publication Data

US 2013/0081332 A1 Apr. 4, 2013

(30) Foreign Application Priority Data

Jun. 8, 2010 (FR) ..... 10 54476

(51) Int. Cl.
*E06B 1/04* (2006.01)

(52) U.S. Cl.
USPC ..... 49/504

(58) Field of Classification Search
USPC ..... 49/504; 52/216, 656.4, 656.6
See application file for complete search history.

(56) References Cited

U.S. PATENT DOCUMENTS

| | | | | |
|---|---|---|---|---|
| 2,475,885 | A * | 7/1949 | Geyser | 52/204.53 |
| 2,840,201 | A * | 6/1958 | Anderson | 52/217 |
| 2,893,070 | A | 7/1959 | Gauthier | |
| 3,596,405 | A * | 8/1971 | Ingulf | 49/504 |
| 4,226,066 | A * | 10/1980 | Persson | 52/211 |
| 4,237,665 | A * | 12/1980 | Molyneux | 52/213 |
| 5,603,191 | A * | 2/1997 | Wu | 52/204.1 |
| 6,192,638 | B1 * | 2/2001 | Wang | 52/213 |
| 6,530,183 | B1 * | 3/2003 | Kuei-Yung | 52/204.1 |
| 8,407,954 | B2 * | 4/2013 | Keith et al. | 52/213 |
| 8,534,000 | B1 * | 9/2013 | Fadlon | 49/504 |
| 2002/0020124 | A1 * | 2/2002 | Kusano et al. | 52/213 |
| 2005/0204635 | A1 * | 9/2005 | Lualdi | 49/504 |

FOREIGN PATENT DOCUMENTS

| | | | | |
|---|---|---|---|---|
| CH | 563 519 AS | | 6/1975 | |
| EP | 0 663 506 | A2 | 7/1995 | |
| FR | 2561300 | A1 * | 9/1985 | E06B 1/20 |
| FR | 2598743 | A1 * | 11/1987 | E06B 7/24 |
| FR | 2 701 287 | A1 | 8/1994 | |

OTHER PUBLICATIONS

International Search Report for corresponding application No. PCT/FR2010/051155 mailed Apr. 26, 2011.

* cited by examiner

*Primary Examiner* — Jerry Redman
(74) *Attorney, Agent, or Firm* — Carter, DeLuca, Farrell & Schmidt LLP

(57) ABSTRACT

The subject of the present disclosure is a prehung door unit structure intended to close an opening, more particularly of rectangular shape, made in a stonework construction such as a wall, rising substantially vertically and separating or demarcating two spaces within a building and, more particularly, within a high-security building, including a prehung door unit made up of at least one door leaf mounted so that it can pivot and of a fixed frame intended to be fitted into said opening. Such a structure further comprises a fixed-frame pre-frame that can be mounted in the recess of the opening and constitutes a support for attaching the prehung door unit so that the prehung door unit can be fixed removably into the opening using rigid and removable connecting means.

17 Claims, 9 Drawing Sheets

PREHUNG DOOR UNIT STRUCTURE

Figure 1:
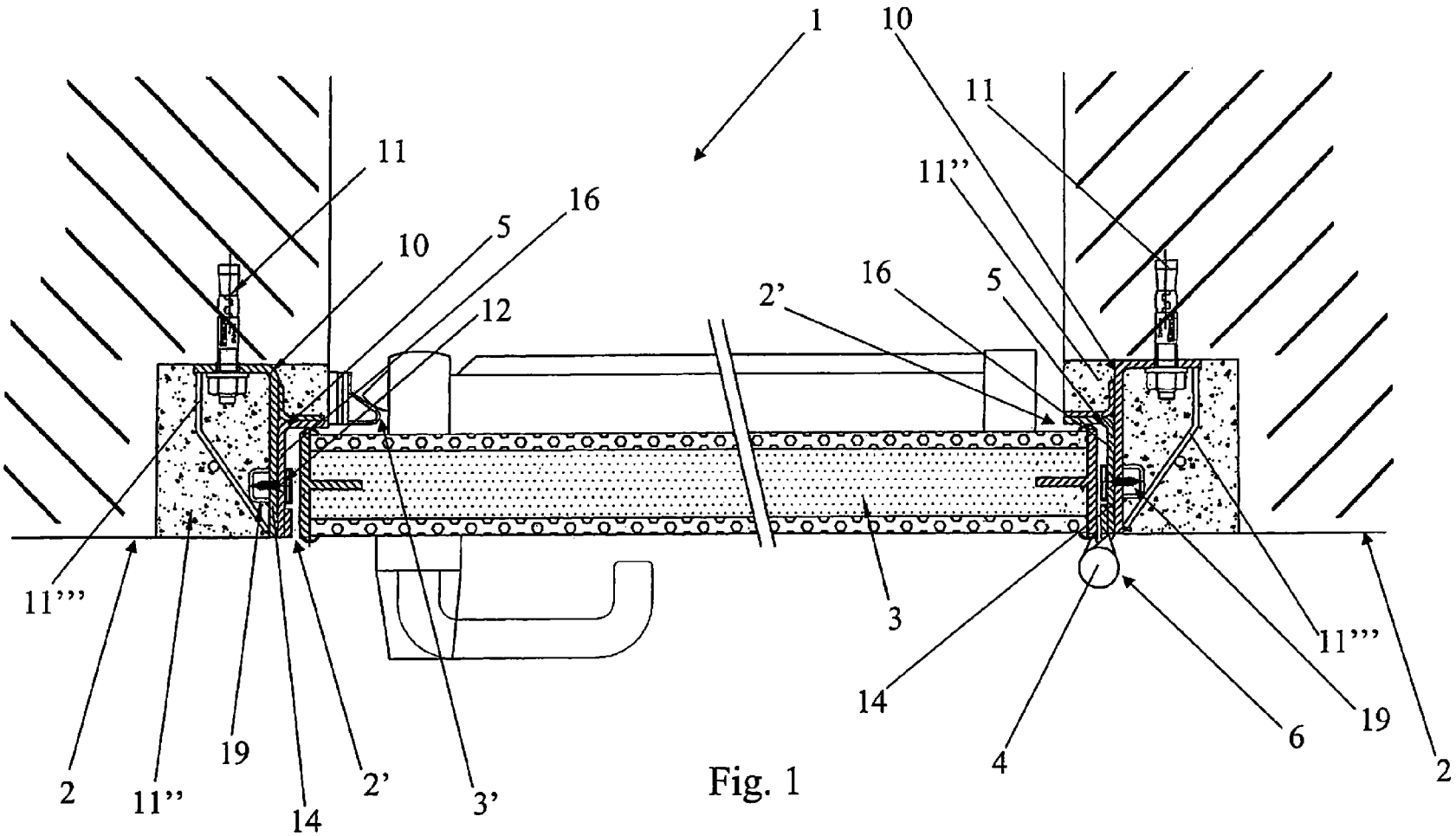

The present invention deals with a prehung door unit or block structure intended to be installed in a building and more particularly a high-security building such as a nuclear power plant building.

It is known that a door unit is basically comprised of, first, a fixed part, usually known as the door frame or case, able to be engaged in an aperture or opening made in a masonry structure, such as a wall, generally extending basically vertically in a building in order to separate or delimit two rooms of the latter, and secondly at least one movable part, hereinafter called the door leaf, able to pivot about an axis, which is generally basically vertical.

Generally speaking, the door frame, which has an overall rectangular shape, is mounted and fixed rigidly in the recess of an opening or doorway, in which it extends basically vertically, and is composed of two vertical leaves, joined together by an upper horizontal crosspiece and optionally by a sill, especially in the case of a sealed door unit forming the bottom part of said door frame, in the installed state in said opening. The leaf comprises two opposite stanchions, extending basically vertically in the installed state of the door unit in said opening, one of which is able to pivot on the corresponding vertical stanchion of the door frame, while the other opposite stanchion of the door leaf is optionally outfitted with a lock.

Door units come in several types, namely, ordinary door units, with or without tightness to air and/or fire and/or gas, and firewall door units, with or without a lock, in particular comprising flame-resistant door units which are tight to the passage of flames and gases, firewall door units resistant to high temperature elevations, and firewall door units that are tight to air and/or water and/or gas.

In the case of door units not having a lock, these are more particularly designed for the bounding off and compartmentalization of zones on fire to prevent the spread of the fire and smoke in the building so outfitted.

As for the door units intended to be installed in high-security buildings, such as the buildings of nuclear power plants, these must obey elevated fire protection and/or security requirements. Such door units generally comprise a door leaf pivoting on a door frame by means of two or three hinge plates, each of which is provided with a movable part welded to one of the vertical edges of the leaf and a fixed part welded to one of the corresponding vertical edges of the door frame.

Furthermore, these door units need to be changed and replaced by an identical door unit or one of a different type when they are defective, impaired or damaged.

On the other hand, a partial or total changing of the door unit may be required when the type of door unit is no longer fit for the desired use, for example, in the event of a changing of purpose of a room closed by an ordinary door unit into a room required to hold expensive or sensitive equipment, such as computer equipment, necessitating a closure by a door unit providing a fire protection or one that is more effective and better suited, such as a firewall or a tight firewall unit.

The operation involved in removing a door unit, especially a door unit installed in an opening of a high-security building, is heavy and demands long periods of work. In fact, such a door unit is rigidly fixed with locking in position in the corresponding opening of the masonry structure and can only be removed by cutting or slicing, using specific tools such as drills or grinders. The same is true of the operation involved in installing a new door unit, which requires long work time including the preparation of the surface containing the old door unit and the making of new welds to secure the new door unit. But the time for maintenance work and shutdown of operations within the facilities in these high-security buildings, especially the buildings of nuclear power plants, needs to be reduced to the strict minimum for understandable reasons of safety and protection of the workers.

The purpose of the present invention is to mitigate these inconveniences by proposing a door unit structure that can simplify the operations of removal and installation of a door unit and reduce in particular the time for the corresponding work, especially as regards the heavy door units used in high-security buildings and more particularly in the buildings of nuclear power plants.

For this, the subject of the present invention is a door unit structure designed to close an opening, more particularly one of rectangular or square shape, made in a masonry structure, such as a wall, extending basically vertically and separating or delimiting two spaces in a building and more particularly in a high-security building, comprising a door unit made up of at least one door leaf, installed to pivot by means of at least two hinge plates, each one provided with a fixed part and a movable part, about a vertical axis, and a door frame comprising two vertical stanchions, an upper transverse crosspiece, and optionally a sill, said door unit being able to engage in a recess made in the thickness of the wall of the opening, and characterized essentially in that it furthermore comprises a pre-frame able to be mounted in the recess of said opening, being held rigidly and locked in position in said recess thanks to respective anchoring and sealing means, and preferably means of prefixation, in the masonry structure, and in that said pre-frame has a fixation support for the door unit, making it possible to fix said door unit in an immovable manner in said opening thanks to rigid and detachable connection means.

Figure 2:
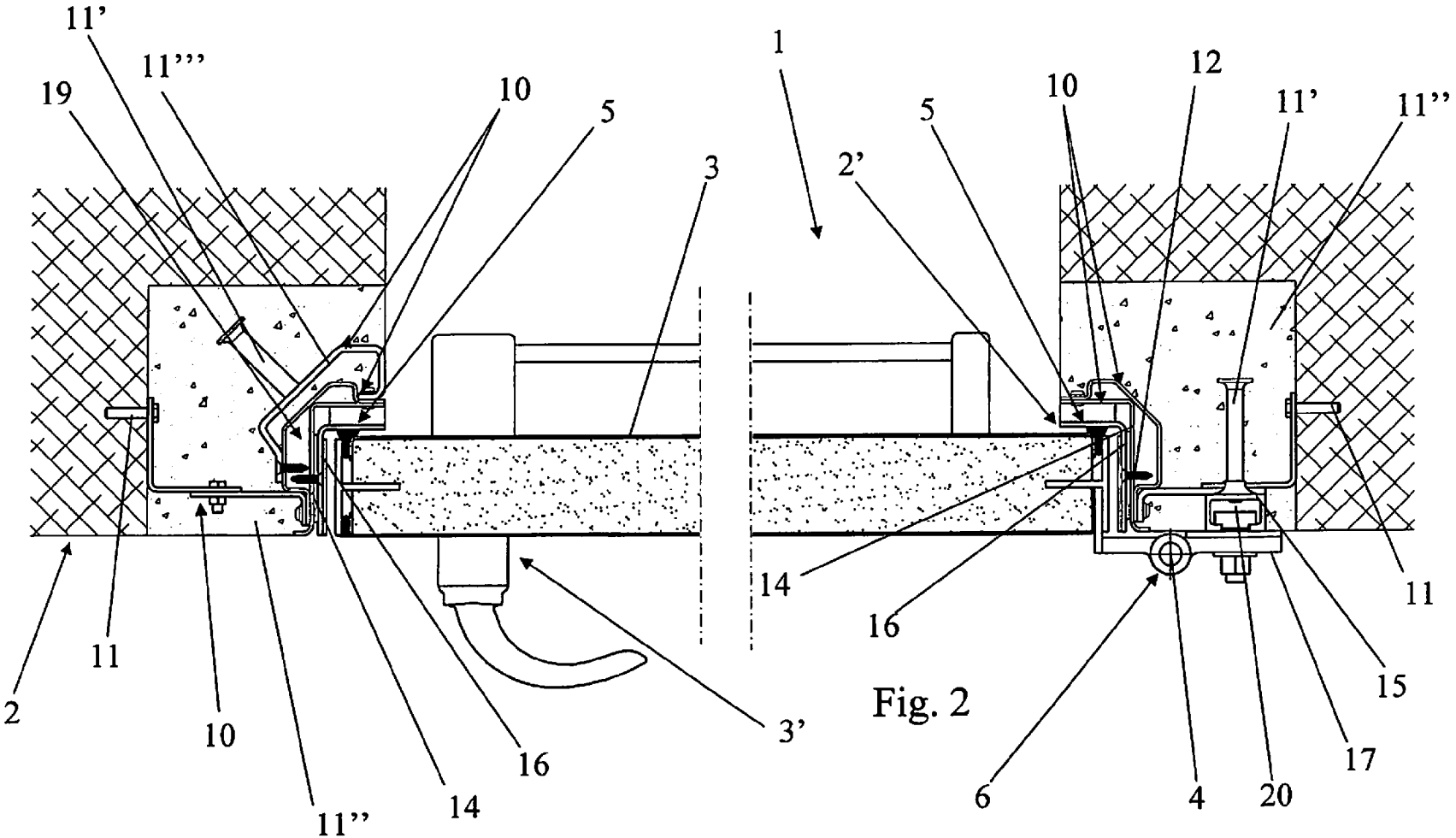
Figure 3:
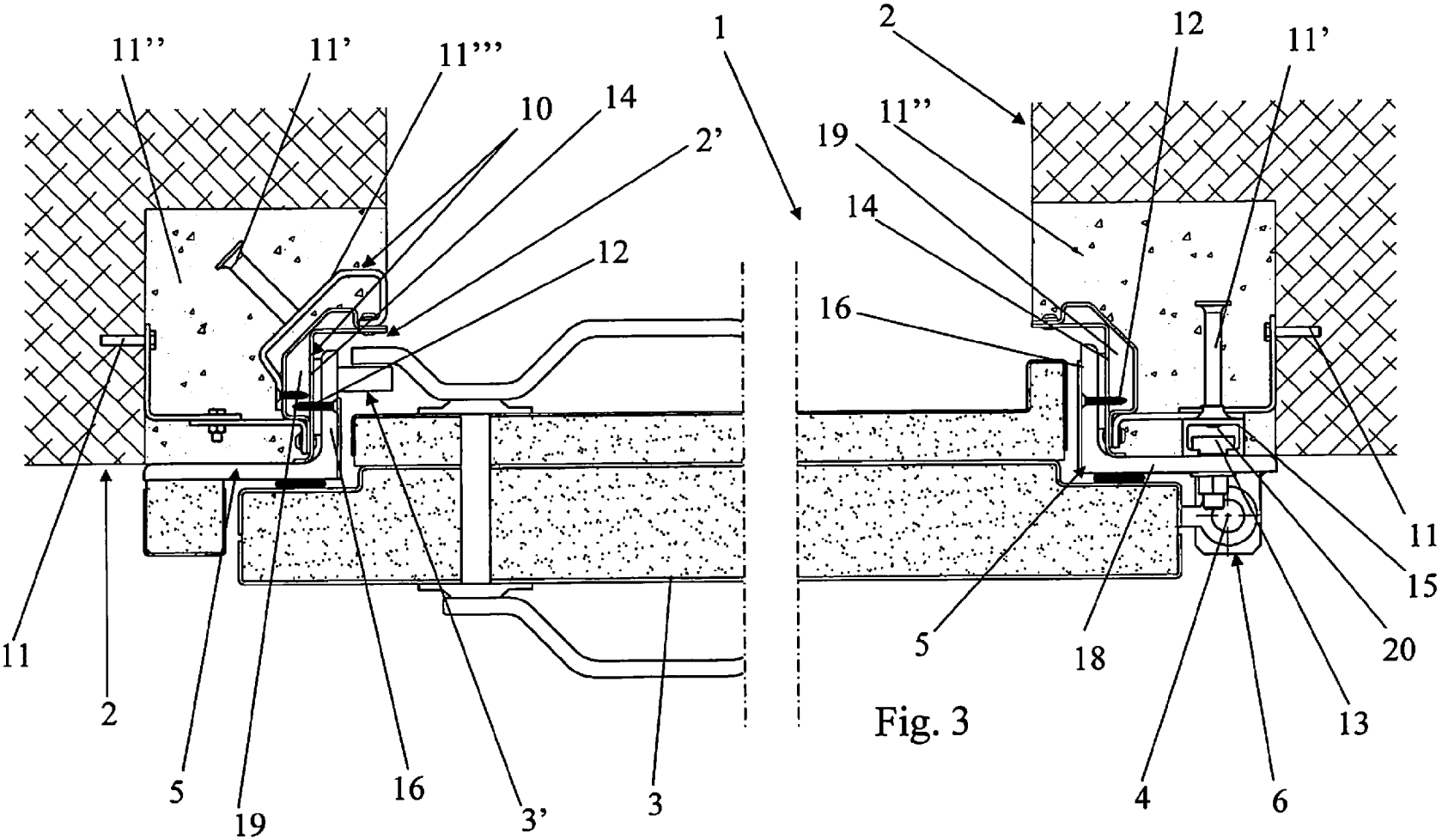
Figure 4:
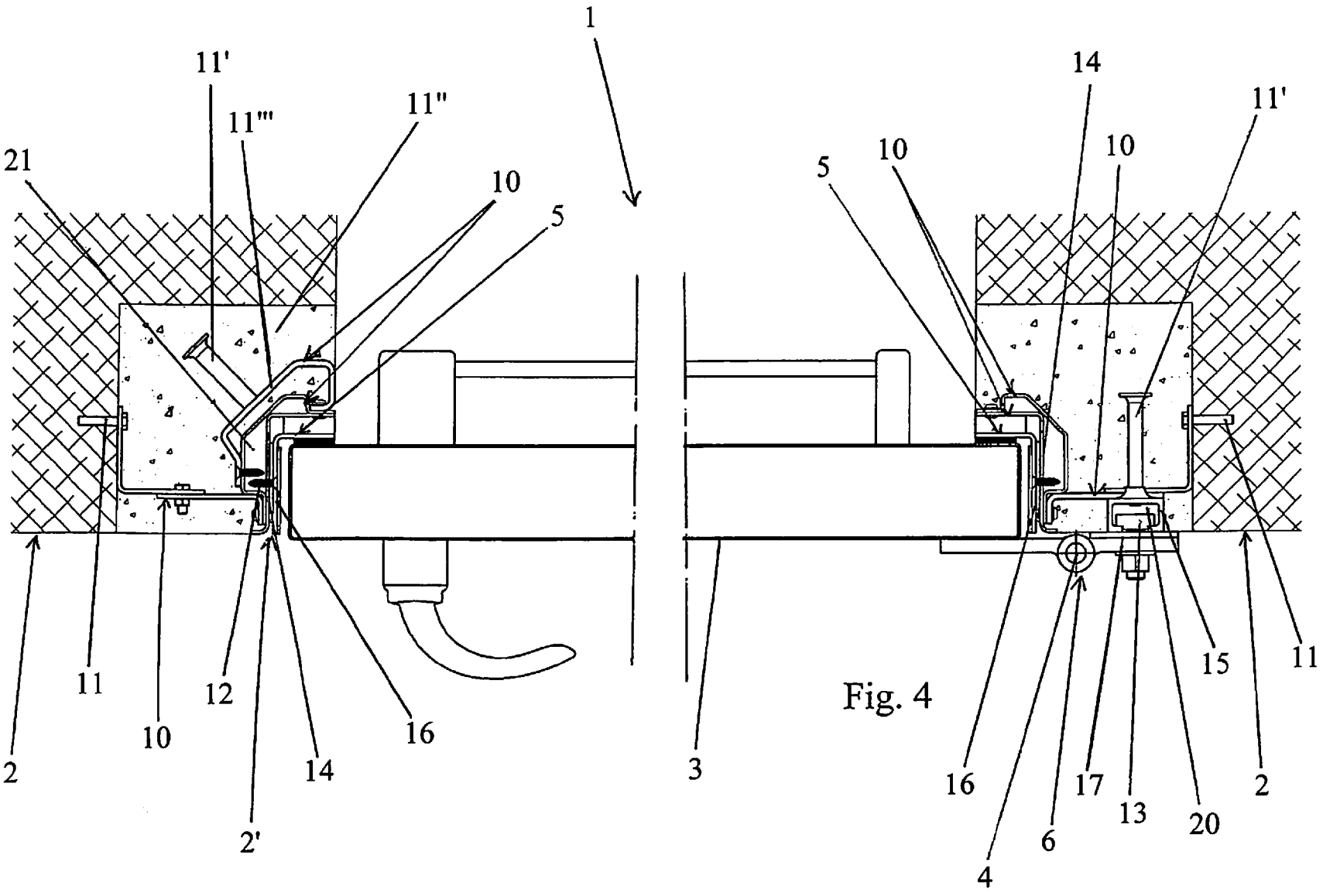
Figure 5:
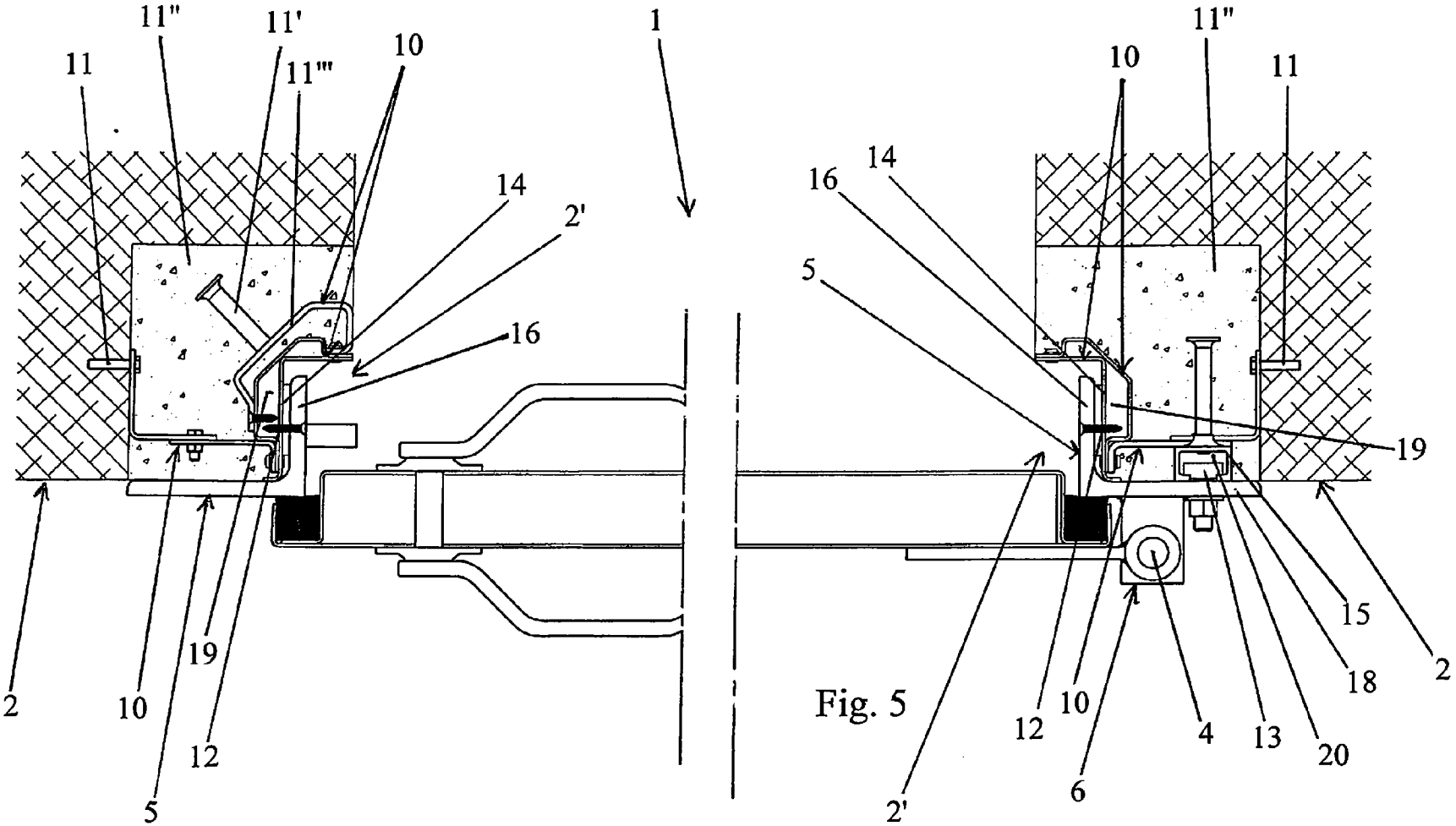
Figure 7:
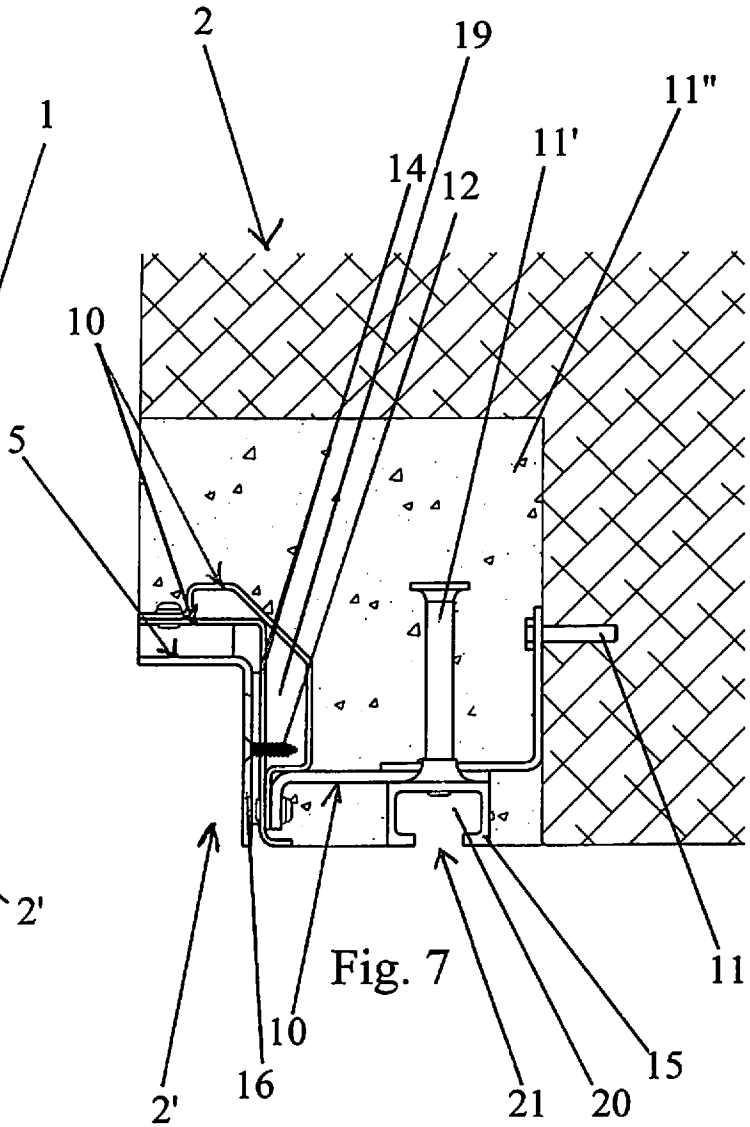
Figure 6:
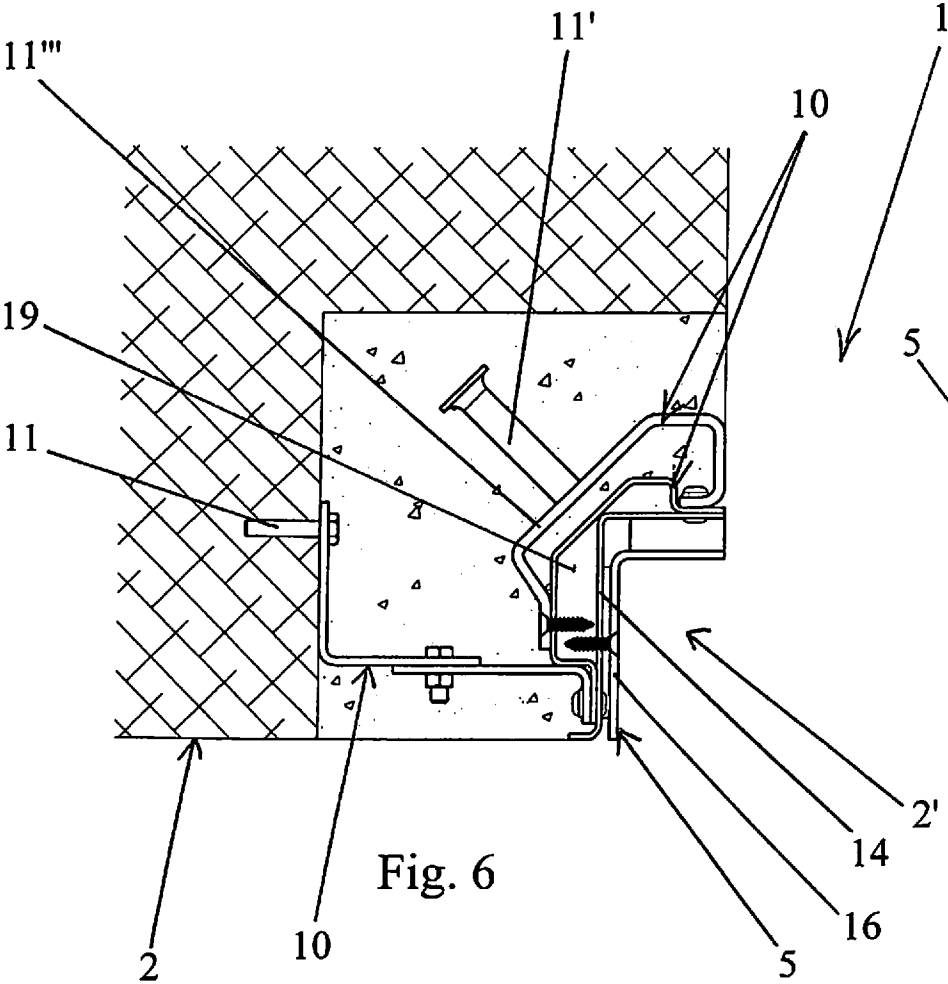
Figure 9:
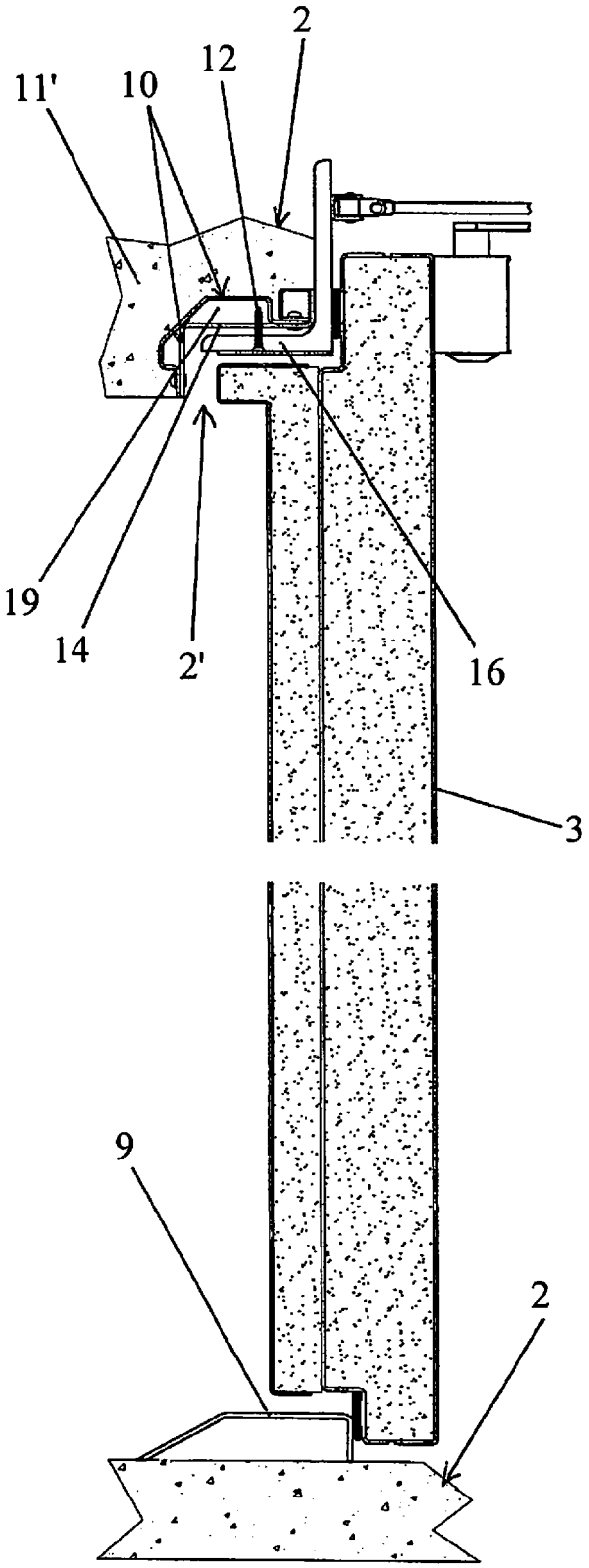
Figure 8:
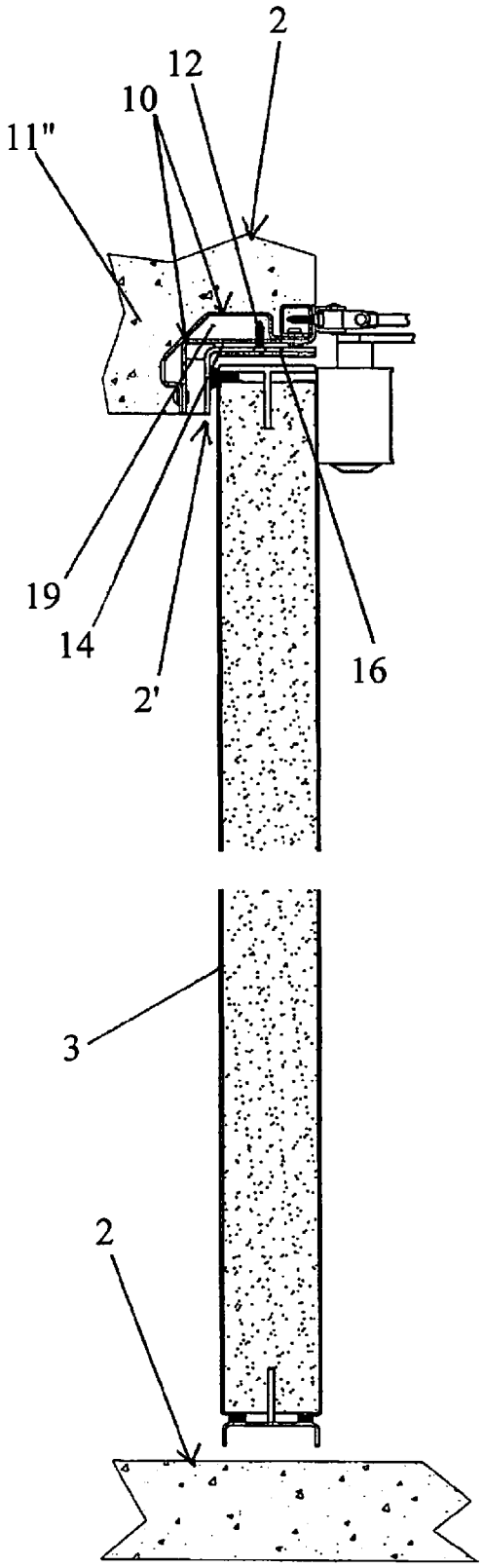

The invention will be better understood thanks to the following description, which pertains to several embodiments given as nonlimiting examples, and explained with reference to the appended schematic drawings, in which:

FIG. 1 shows a cross sectional view of a door unit structure according to the present invention, in a first embodiment and in a firewall configuration, in the installed state in an opening made in a masonry structure of a high-security building, FIG. 2 shows a cross sectional view of a door unit structure according to the present invention, in a second embodiment and in a firewall configuration, in the installed state in an opening made in a masonry structure of a high-security building, FIG. 3 shows a cross sectional view of a door unit structure according to the present invention, in a third embodiment and in a tight firewall configuration, in the installed state in an opening made in a masonry structure of a high-security building, FIG. 4 shows the door unit structure represented in FIG. 2 in a flame-stopping configuration, FIG. 5 shows the door unit structure represented in FIG. 3 in an ordinary door unit configuration that is air, water and gas tight, FIG. 6 shows the pre-frame and the frame of the door unit structure represented in FIG. 2 and in FIG. 4, at the side opposite the one cooperating with the hinge plates, FIG. 7 shows the pre-frame and the frame of the door unit structure represented in FIG. 2 and FIG. 4, at the hinge plate side, FIG. 8 shows a vertical sectional view of the door unit system represented in FIG. 2, FIG. 9 shows a vertical sectional view of the door unit system represented in FIG. 3.

Figure 10:
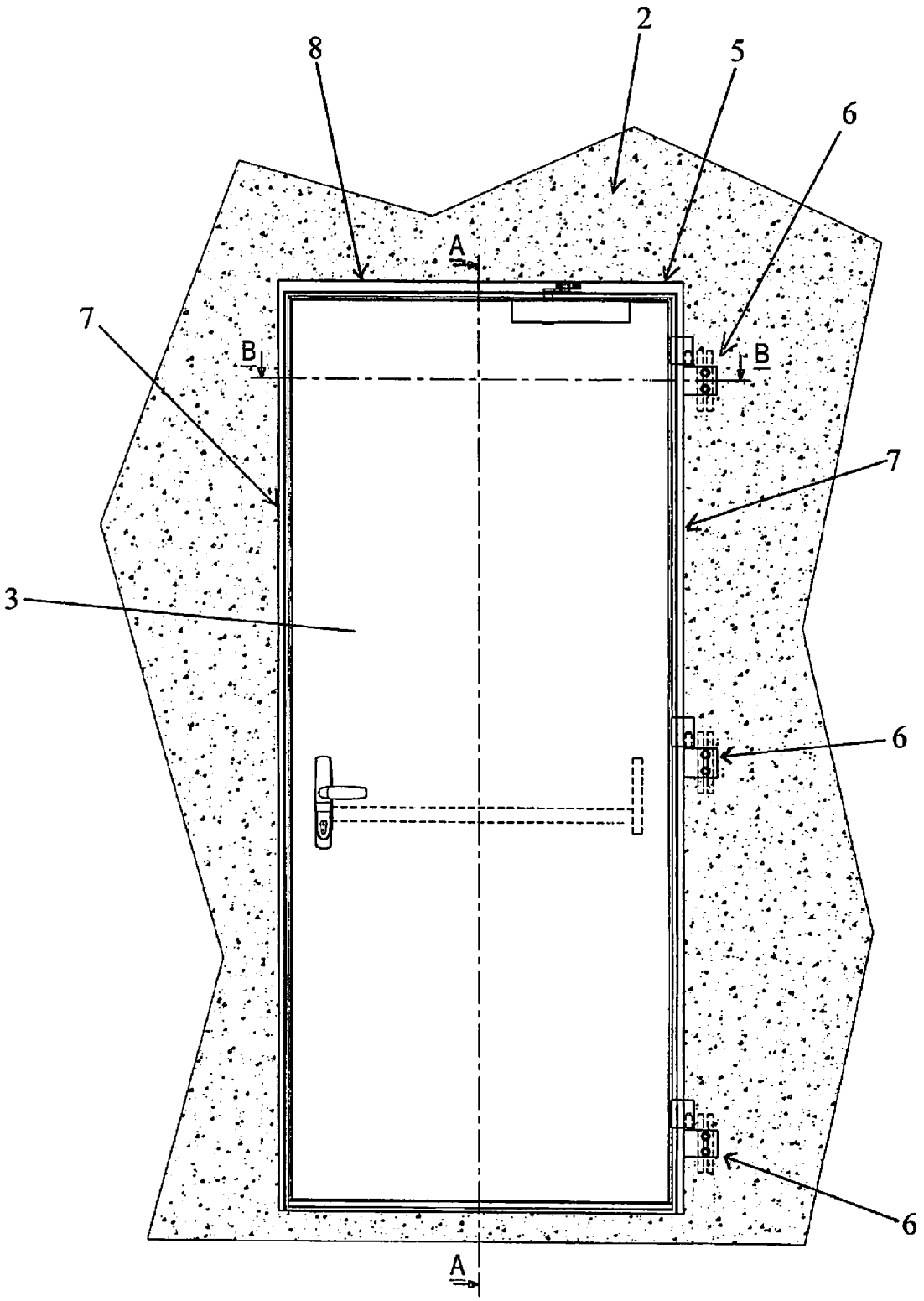
Figure 11:
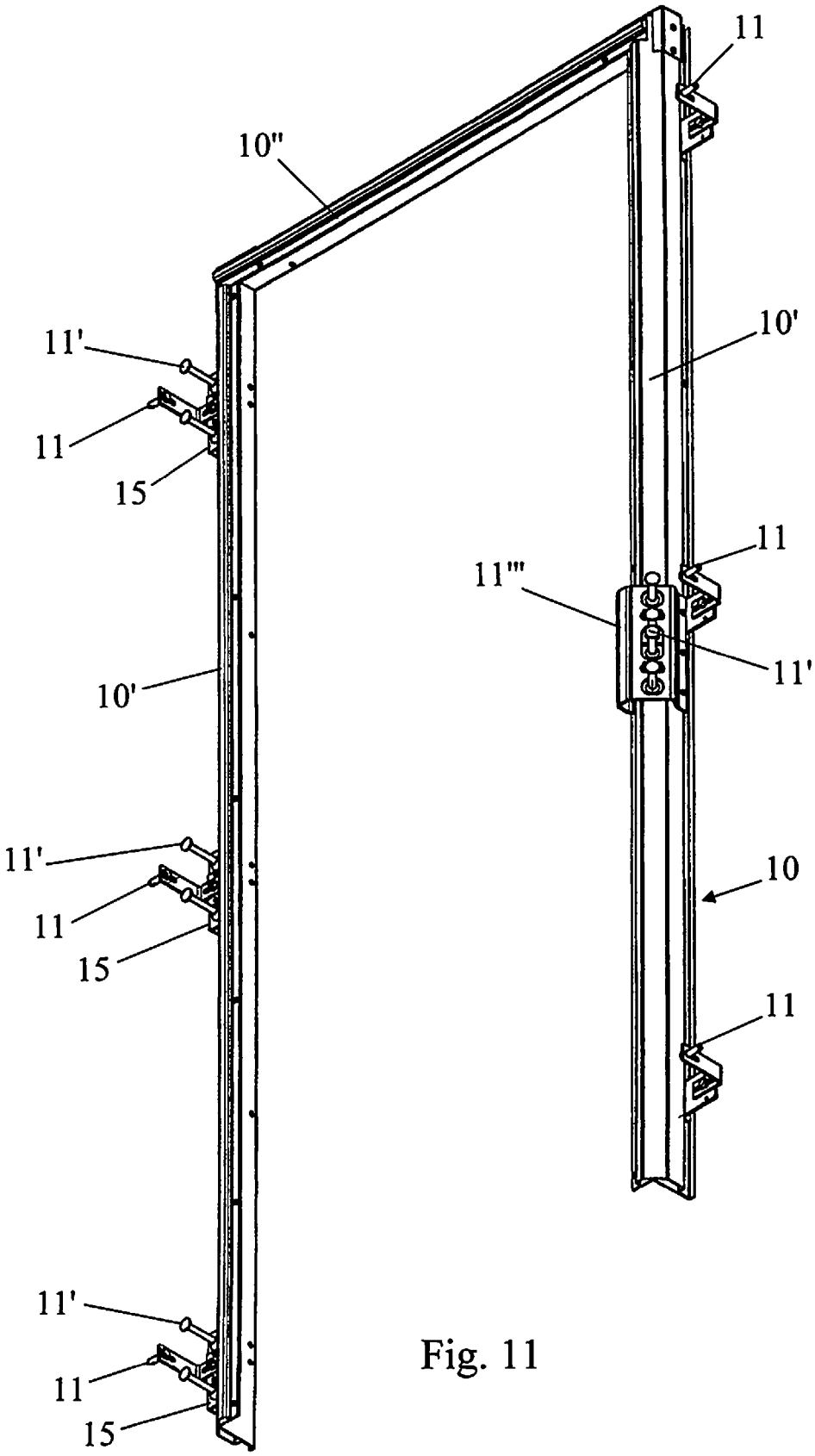

FIG. 10 shows a front view of a door unit, front side, in the installed state in a masonry opening in a high-security building, in the condition of locking of the door, FIG. 11 shows a perspective view of a U-shaped door frame of a door unit structure according to the present invention.

The figures show a door unit structure according to the present invention, designed to close an opening or doorway 1, more particularly one of rectangular or square shape, made in a masonry structure 2, such as a wall, extending basically vertically and separating or delimiting two spaces in a building and more particularly in a high-security building, such as a building of a nuclear power plant, comprising a door unit 3, 4, 5 made up of at least one door leaf 3, installed to pivot by means of at least two hinge plates 6, each one provided with a fixed part and a movable part, about a vertical axis 4, and a door frame 5 comprising two vertical stanchions 7, an upper transverse crosspiece 8, and optionally a sill 9, more particularly in the case of a tight firewall door unit, said door unit 3, 4, 5 being able to engage in a recess 2' made in the thickness of the wall 2 of the opening 1.

According to the present invention, such a structure furthermore comprises a pre-frame 10 able to be mounted in the recess 2' of the opening 1, being held rigidly and locked in position in said recess 2' thanks to respective anchoring 11', 11''' and sealing 11" means, and optionally and preferably means of prefixation 11, in the masonry structure 2, said pre-frame 10 having a fixation support for the door unit 3, 4, 5, making it possible to fix said door unit 3, 4, 5 in an immovable manner in said opening 1 thanks to rigid and detachable connection means 12, 13.

It will be understood that, in the case when the door unit 3, 4, 5 according to the present invention has means of prefixation 11 of the pre-frame 10, the latter is susceptible of being mounted and prefixed in the opening 1 prior to the mounting of the door frame 5 in the opening 1 on said door frame 10.

Preferably, the pre-frame 10 can comprise at least one receiving support piece 14, 15 and the door unit 3, 4, 5 can comprise at least one assembly piece 16, 17, 18 able to be assembled with a receiving support piece 14, 15 by locking with pressure against each other thanks to the rigid and detachable connection means 12, 13 that can be, for example, screws 12 or bolts 13.

If one refers to FIG. 11, one can see that the pre-frame 10 can have an overall U-shape, comprising two vertical stanchions 10' joined together by an upper horizontal crosspiece 10" and that said stanchions 10' and said crosspiece 10" can be made from rigid plate profile members or another elongated flat element of hard and rigid material, preferably bent lengthwise so as to present an overall L-shaped cross section.

Furthermore, as one can see [in] FIGS. 1 to 7, the pre-frame 10 is susceptible of being, on the one hand, prefixed in the concrete shell or first-phase concrete of the masonry structure 2 thanks to the prefixation means 11 and on the other hand fixed rigidly and definitively in the masonry structure 2 thanks to the anchoring means 11', 11''' and the sealing means 11".

Preferably, the anchoring means 11', 11''' of the pre-frame 10 in the masonry structure 2 can consist, for example, of at least one anchoring leg 11' and/or at least one bent plate 11''' and the sealing means 11" can consist, for example, of a micro-concrete or second-phase concrete cast onto said prefixed pre-frame 10.

FIG. 1 shows the anchoring means 11' consisting solely of at least one bent plate, whereas the other figures show anchoring means 11', 11''' consisting of at least one anchoring leg 11' and at least one plate 11", preferably rigid and bent. The anchoring legs 11' can also be designed to be fixed directly on a bent plate 11''', as can be seen in particular in FIG. 11, where one of the vertical stanchions 10' of the pre-frame 10 opposite the one located on the side of the hinge plates 6, not shown, comprises, basically at the center, anchoring means 11', 11''' that consist of a bent plate 11''' extending at a distance from the opposite vertical stanchion, and anchoring legs 11' extend from the outer surface of said bent plate 11'''.

Moreover, a seat or a reservation 19, 20 can be devised in each receiving support piece, respectively 14, 15, to allow for receiving the corresponding rigid and detachable connection means 12, 13. A reservation 19, 20 can be realized, for example, by means of a rigid plate or other rigid flat element fixed to the inner surface of the receiving support piece 14 and bent to form a receiving and protecting cavity, so as to prevent the micro-concrete 11" from filling each reservation 19, 20 during the sealing of the prefixed pre-frame 10 and so that the fixation holes of the door unit 3, 4, 5 on the receiving support piece or pieces 14, 15 of the pre-frame 10 are not united by the micro-concrete 11".

Furthermore, a receiving support piece 15 can consist of a profiled insert of overall C-shaped cross section that can advantageously be sealed, with anchoring, in the masonry structure 2 (FIGS. 2, 3, 4, 5, 7, 10). In this case, the aforesaid reservation 20 can advantageously consist of the inner space of said C-shaped profiled insert, opening onto the opening 21 of the C.

The opening 21 of the C-shaped profiled insert 15 can be designed advantageously flush with the outer surface of the masonry structure 2 and able to receive at least one rigid and dismountable connection means 13, such as a hook-head or a hammerhead bolt, designed to achieve a locking by pressure of a corresponding assembly piece 17, 18 of the door unit 3, 4, 5 against said profiled insert 15 and said outer surface of the masonry structure 2.

Such a C-shaped profiled insert 15 can preferably have characteristics enabling a strong load restoration in the longitudinal direction of the profile, known by the commercial name of "HALFEN rail", not patented, and perfectly meeting the requirements of vertical installations and high dynamic loads of a door unit of very heavy weight as used in high-security buildings, such as the buildings of nuclear power plants.

Furthermore, in this type of C-shaped profiled insert 15 the two inner edges of the C opening 21 can preferably be notched and can cooperate with a notched inner surface of the head of the locking bolt, forming a rigid and dismountable connection means 13 so as to eliminate any risk of sliding of the load (door unit) after adjusting its position and its fixation to said C-shaped profiled insert 15.

An anchoring means 11' such as an anchoring leg can also advantageously constitute an anchoring means of a C-shaped profiled insert 15 forming part of the pre-frame 10 and it can extend, for example, perpendicularly from the rear surface of said profiled insert 15 opposite the front surface containing the C-shaped opening 21. Preferably, each C-shaped profiled insert can have two anchoring legs 11'. On the other hand, the present invention can have the door unit 3, 4, 5 preferably comprise one C-shaped profiled insert for each hinge plate 6, as can be seen in FIG. 11, which shows a pre-frame 10 containing three C-shaped profiled inserts 15 extending laterally from one of the vertical stanchions 10' of said pre-frame 10, outwardly from the latter, and each of them able to cooperate with a corresponding hinge plate 6 of a door leaf 3, not shown in FIG. 11.

In a first embodiment of the door unit structure according to the present invention, the fixed part of each hinge plate 6 of each door leaf 3 can be fixed to one of the vertical stanchions 7 of the door frame 5. Moreover, the door frame 5 can comprise at least one assembly piece 16 able to be locked by pressure against a receiving support piece 14 of the pre-frame 10 in the recess 2' of the opening 1 (FIG. 1).

Preferably, the opening 21 of the C-shaped profiled insert 15 can be essentially flush with the outer surface of the masonry structure 2 in a zone set back from the recess 2', in order to situate the vertical axis 4 of pivoting of the door leaf 3 some ways back from said recess 2', so as to enable the clearing of the opening 1 by a lateral disengagement of the door leaf 3 from the opening 1 when it is in a position of release opening, especially at 90° to the plane of the opening 1 (FIG. 2, 3, 4, 5).

In a second embodiment of the door unit structure according to the present invention, the fixed part of each hinge plate 6 of each door leaf 3 comprises an assembly piece 17 able to be locked by pressure, thanks to a rigid and dismountable connection means 13, against a corresponding C-shaped profiled insert 15 and the corresponding portion of the outer surface of the masonry structure 2, so as to allow a transfer of forces directly into the masonry structure 2. The C-shaped profiled inserts 15 also advantageously allow an adjustment of the height of the door leaf 3 in the opening 1. Furthermore, the door frame 5 can comprise at least one assembly piece 16 able to be locked by pressure thanks to a rigid and dismountable connection means 12 against a corresponding receiving support piece 14 of the pre-frame 10 (FIG. 2 and FIG. 4).

In a third embodiment of the door unit structure according to the present invention, the door frame 5 can extend from the recess 2', at least, as far as the level of each C-shaped profiled insert 15 and the fixed part of each hinge plate 6 can be fixed to said extension of the door frame 5, so as to be basically situated at the level of or in proximity to a C-shaped profiled insert 15. Furthermore, at least one portion of said extension can comprise an assembly piece 18 able to be locked by pressure thanks to a rigid and dismountable connection means 13 against a corresponding C-shaped profiled insert 15 and against the corresponding portion of the outer surface of the masonry structure 2. Moreover, said door frame 5 can comprise at least one assembly piece 16 able to be locked by pressure thanks to a rigid and dismountable connection means 12 against a corresponding receiving support piece 14 of the pre-frame 10 in the recess 2' (FIG. 3 and FIG. 5).

The door frame 5 of a door unit structure according to the present invention can preferably be made from profile members placed end to end, each of them made from an elongated and flat element of rigid material having temperature and fire resistance properties, such as a rigid plate, optionally containing a longitudinal bend, able to be applied, directly or indirectly, against at least one of the surfaces of the base of the recess 2'. The door frame 5 more particularly can present a profile with an overall L-shaped cross section. Thus, one of the arms of the L can be fixed to the pre-frame 10 in the recess 2', while in a specific orientation of the L the other arm can extend against the outer surface of the masonry structure 2, at least as far as the level of the C-shaped profiled inserts (FIGS. 3 and 5).

It will be understood that this extension of the door frame 5 outside of or beyond the recess 2', in the outer surface plane of the masonry structure 2, can also be realized on the side with the upper horizontal crosspiece 8 (FIG. 9) and the side with the lock 3' (FIG. 3 and FIG. 5).

Of course, the invention is not limited to the embodiment as described and represented in the appended drawings. Modifications remain possible, especially from the viewpoint of the constitution of the various elements or by substitution of technical equivalents, without thereby leaving the domain of protection of the invention.

The invention claimed is:

1. A door unit structure designed to close an opening made in a wall, extending vertically and separating or delimiting two spaces in a building comprising:

a prehung door unit made up of at least one door leaf, installed to pivot by at least two hinge plates, each one provided with a fixed part and a movable part, about a vertical axis;

a door frame including two vertical stanchions and an upper transverse crosspiece, the prehung door unit being able to engage in a recess made in a thickness of the wall of the opening; and a pre-frame able to be mounted in the recess of the opening, and held and locked in position in the recess by respective anchoring and sealing, the pre-frame including a fixation support for the prehung door unit such that the door unit is fixed in an immovable manner in the opening by a rigid and detachable connection.

2. The door unit structure according to claim 1, wherein the pre-frame includes at least one receiving support piece and the prehung door unit includes at least one assembly piece able to be assembled with the at least one receiving support piece by locking with pressure against each other by the rigid and detachable connection, and wherein a seat is devised in each receiving support piece to allow for receiving the corresponding rigid and detachable connection.

3. The door unit structure according to claim 2, wherein the at least one receiving support piece of the pre-frame includes a profiled insert of overall C-shaped cross section configured to be sealed, with anchoring, in the wall, and wherein an opening of the C-shaped profiled insert is designed flush with an outer surface of the wall and able to receive at least one rigid and dismountable connection designed to achieve a locking by pressure of a corresponding assembly piece of the prehung door unit against the at least one receiving support piece and a corresponding portion of the outer surface of the wall.

4. The door unit structure according to claim 3, wherein the opening of the C-shaped profiled insert is essentially flush with the outer surface of the wall in a zone set back from the recess, in order to situate the vertical axis of pivoting of the door leaf set back from the recess, so as to enable clearing of the opening by a lateral disengagement of the door leaf from the opening when the door leaf is in a position of release opening.

5. The door unit structure according to claim 4, wherein the fixed part of each hinge plate of each door leaf comprises an assembly piece able to be locked by pressure, by a rigid and dismountable connection against a corresponding C-shaped profiled insert and a corresponding portion of the outer surface of the wall, so as to allow a transfer of forces directly into the wall, and the door frame comprises at least one assembly piece able to be locked by pressure by a rigid and dismountable connection against a corresponding receiving support piece of the pre-frame.

6. The door unit structure according to claim 4, wherein the door frame extends from the recess at least as far as a level of each C-shaped profiled insert, the fixed part of each hinge plate being fixed to an extension of the door frame, so as to be situated at the level of or in proximity to a C-shaped profiled insert, and wherein at least one portion of the extension comprises an assembly piece able to be locked by pressure by a rigid and dismountable connection against a C-shaped profiled insert and against the corresponding portion of the outer surface of the wall, and wherein the door frame comprises at least one assembly piece able to be locked by pressure by a rigid and dismountable connection against the corresponding receiving support piece of the pre-frame in the recess.

7. The door unit structure according to claim 4, wherein the position of the release opening is at 90° to a plane of the opening.

8. The door unit structure according to claim 2, wherein each hinge plate of each door leaf is fixed to one of the vertical stanchions of the door frame and the latter comprises at least one assembly piece able to be locked by pressure against the at least one receiving support piece of the pre-frame in the recess of the opening.

9. The door unit structure according to claim 1, wherein the pre-frame has an overall U-shape, comprising two vertical stanchions joined together by an upper horizontal crosspiece, the two vertical stanchions and the upper horizontal crosspiece being made from rigid plate profile members or another elongated flat element of rigid material, bent lengthwise so as to present an overall L-shaped cross section.

10. The door unit structure according to claim 1 wherein the pre-frame is susceptible of being prefixed in the concrete shell by a prefixation and fixed rigidly and definitively in the wall by the anchoring and the sealing onto the prefixed pre-frame.

11. The door unit structure according to claim 10, wherein the anchoring includes at least one of: at least one anchoring leg and at least one rigid bent plate.

12. The door unit structure according to claim 1, wherein the door frame is made from profile members placed end to end, each of them made from an elongated and flat element of rigid material having temperature and fire resistance properties able to be applied, directly or indirectly, against at least one surface of a base of the recess.

13. The door unit structure according to claim 12, wherein the elongated and flat element is a rigid plate.

14. The door unit structure according to claim 13, wherein the elongated and flat element further includes a longitudinal bend.

15. The door unit structure according to claim 1, wherein the opening is at least one of a rectangular or square shape.

16. The door unit structure according to claim 1, wherein the at least one rigid and dismountable connection is selected from the group consisting of a hook head and hammerhead bolt.

17. The door unit structure according to claim 1, wherein the door frame further comprises a sill.

* * * * *